United States Patent [19]

Varwig

[11] Patent Number: 4,843,734

[45] Date of Patent: Jul. 4, 1989

[54] COOLING DEVICE FOR WIRE TURNS

[75] Inventor: Karlheinz Varwig, Mülheim, Fed. Rep. of Germany

[73] Assignee: Mannesmann Aktiengesellschaft, Dusseldorf, Fed. Rep. of Germany

[21] Appl. No.: 171,846

[22] Filed: Mar. 22, 1988

[30] Foreign Application Priority Data

Mar. 26, 1987 [DE] Fed. Rep. of Germany ..... 3709936

[51] Int. Cl.[4] ..... F26B 25/00

[52] U.S. Cl. ..... 34/107; 34/62

[58] Field of Search ..... 34/105, 148, 62, 107, 34/225

[56] References Cited

U.S. PATENT DOCUMENTS 2,166,056 7/1939 Johnston ..... 34/107

3,281,957 11/1966 Ranney et al. ..... 34/156

*Primary Examiner*—Henry A. Bennet

*Attorney, Agent, or Firm*—Nils H. Ljungman

[57] ABSTRACT

This invention relates to a cooling device for wire turns which, overlapping one another, are spread out on a horizontal conveyor and cooled by air which can be supplied through transverse slots below the conveyor in an intensity which can be modified over the width of the packet of turns. To create a precisely adjustable feed of cooling air on a generic cooling device for wire turns, which makes possible an optimal distribution of the cooling air for uniform cooling of a rolling program, the invention proposes that to adjust the opening of the transverse slots, the slots can be covered at least partly by horizontally movable shutters.

15 Claims, 3 Drawing Sheets

COOLING DEVICE FOR WIRE TURNS

BACKGROUND OF THE INVENTION

1. Field of the Invention:

This invention relates to a cooling device for turns of rolled wire which, overlapping one another, are spread out on a horizontal conveyor and cooled by air which can be supplied through transverse slots below the conveyor in an intensity which can be varied over the width of the turns of a packet.

2. Description of the Prior Art:

In the prior art, such cooling devices are used to achieve controlled modifications of the metallurgical characteristics of rolled wire by means of controlled cooling. On installations of this type, the rolled wire is spread out by a rotating wire turn spreader into individual turns which, when placed on a conveyor, lie flat overlapping one another, whereby the size of the overlaps is a function of the transport speed of the conveyor.

On account of the accumulations of the material contained in the wire turns in the peripheral zones of the packets of wire rings formed in this manner, increased peripheral cooling is necessary. For this purpose, it has been proposed that the air flow nozzles be distributed over the diameter of the turns and the transport direction, so that the amount of cooling air available can be distributed as a function of the material accumulations. This has the disadvantage that the arrangement of nozzles cannot be optionally set for all the different wire diameters, transport speeds and grades of rolled steel, and that with this arrangement, a uniform cooling of the wire turns of a rolling program cannot be achieved.

The prior art also includes a solution in which the cooling air delivered by a fan is deflected in the air shaft, ahead of the nozzles below the conveyor, by air distribution valves and deflectors, so that it becomes possible to divide the air between two peripheral zones and one central zone. This proposal has the disadvantage that the division of the amounts of air and the adjustment of the airflow speed can only be made between the central region and the peripheral zones. The material accumulation, however, which for spread out wire turns increases parabolically outward, requires a more precisely adjustable feed of cooling air than is possible with this cooling system. There are also flow losses and turbulence inside the air feed shaft on account of additional valves, control rods and bearings.

OBJECT OF THE INVENTION

The object of this invention is to create a precisely adjustable feed of cooling air in a generic cooling device for wire turns, which makes possible an optimal distribution of the cooling air and the uniform cooling of a rolling program. This object is achieved by the invention in that to change the opening of the transverse slots, the latter can be at least partly covered by horizontally movable shutters. Another characteristic of the invention is that the control edges of at least some of the shutters covering the transverse slots run diagonal to the direction in which they are moved and/or to the transverse slots.

SUMMARY OF THE INVENTION

In the present invention, the nozzles in the required area can be precisely adjusted simply by opening or closing the shutters, and thus the amount of cooling air supplied can be optimally adjusted to the area in question. As a result of the diagonal configuration of the control edges of the shutters, when these shutters are moved, the slot can not only be varied in the direction of movement, but also continuously and precisely in the transverse direction.

One particularly favorable characteristic of the invention is that over the width of the transverse slots, there are several shutters next to one another and running along the horizontal conveyor. The invention makes it possible to create several zones over the width of the wire turns, whereby preferably and according to another characteristic of the invention, the shutters can be moved individually or in groups.

In one favorable configuration of the invention, the shutters comprise slotted plates covering several slotted nozzles located behind one another. The slotted plates have slots, the distance between which corresponds to the distance between the transverse slots, and whose cross section at least equals the cross section of the transverse slots. According to another characteristic of the invention, there are preferably five slotted plates over the width of the horizontal conveyor, whereby the two outermost slotted plates and the slotted plates adjacent to them can each be moved in pairs in the direction of transport of the wire turns, whereby the slots of the other slotted plates run diagonal to the transverse slots, as a function of the material accumulations expected there.

On account of the division into five separate control segments over the diameter of the wire ring, and the air slots which open diagonally in the required zones, every portion of the wire rings can be cooled with the required air speed and amount of air. The cooling rate of all the wire rings is controlled to obtain the maximum possible uniformity over the entire rolled length. The desired cooling rate can be continuously adjusted up to the maximum value, and flow losses in the air feed shaft are reduced to a minimum.

For delayed cooling on a covered roller table, i.e. without the injection of cooling air, all the nozzles are completely closed. It thereby becomes possible to avoid a chimney effect as a result of hot air escaping upward and cold air being drawn in through open nozzles, as could occur on installations of the prior art, which means that the cooling can be delayed even longer, if desired.

One aspect of the invention resides broadly in a cooling apparatus for cooling a plurality of turns of wire, the apparatus comprising: an arrangement for receiving the turns of wire, the receiving arrangement comprising a horizontal conveyor, the horizontal conveyor having an upper portion for receiving the turns of wire and a width dimension; an arrangement for directing air towards the horizontal conveyor and for directing air towards the turns of wire when disposed on the horizontal conveyor, the arrangement for directing air being disposed below the upper portion of the horizontal conveyor and for directing air substantially upwardly towards the upper portion which is for receiving the turns of wire; an arrangement for supplying air to the air directing arrangement for cooling turns of wire disposed on the upper portion, the air supplying arrangement comprising a plurality of transversely disposed slots, the slots having a length dimension and a width dimension, the length dimension being disposed across the width of the conveyor, the air supplying arrangement having apparatus for directing the cooling air through the slots, the slots having an adjustment arrangement for varying a flow of cooled air through at least a portion of the slots; and the adjustment arrangement comprising an apparatus for varying the openings of the transverse slots and thus, for substantially continuously varying the intensity of air flowing through at least a portion of the slots for providing greater air flow intensity over portions of the plurality of wire turns having greater proximity to one another than portions of the wire turns having less proximity to one another, and at least one intermediate flow intensity thereinbetween.

Another aspect of the invention resides broadly in a cooling apparatus for cooling a plurality of turns of wire, the apparatus comprising: an arrangement for receiving the turns of wire, the receiving arrangement comprising a horizontal conveyor, the horizontal conveyor having an upper portion for receiving the turns of wire and a width dimension; an arrangement for directing air towards the horizontal conveyor and for directing air towards the turns of wire when disposed on the horizontal conveyor, the arrangement for directing air being disposed below the upper portion of the horizontal conveyor and for directing air substantially upwardly towards the upper portion which is for receiving the turns of wire; an arrangement for supplying air to the air directing arrangement for cooling turns of wire disposed on the upper portion, the air supplying arrangement comprising a plurality of transversely disposed slots, the slots having a length dimension and a width dimension, the length dimension being disposed across the width of the conveyor, the air supplying arrangement having apparatus for directing the cooling air through the slots, the slots having an adjustment arrangement for varying a flow of cooled air through at least a portion of the slots; and the adjustment arrangement comprising a plurality of at least partially movable shutters for varying the openings of the transverse slots and thus, for varying flow characteristics of air flowing through at least a portion of the slots for providing greater air flow intensity over portions of the plurality of wire turns having greater proximity to one another than portions of the wire turns having less proximity to one another.

One embodiment of the invention is illustrated in the accompanying drawings and is illustrated below.

DESCRIPTION OF THE PREFERRED EMBODIMENTS

Figure 1:
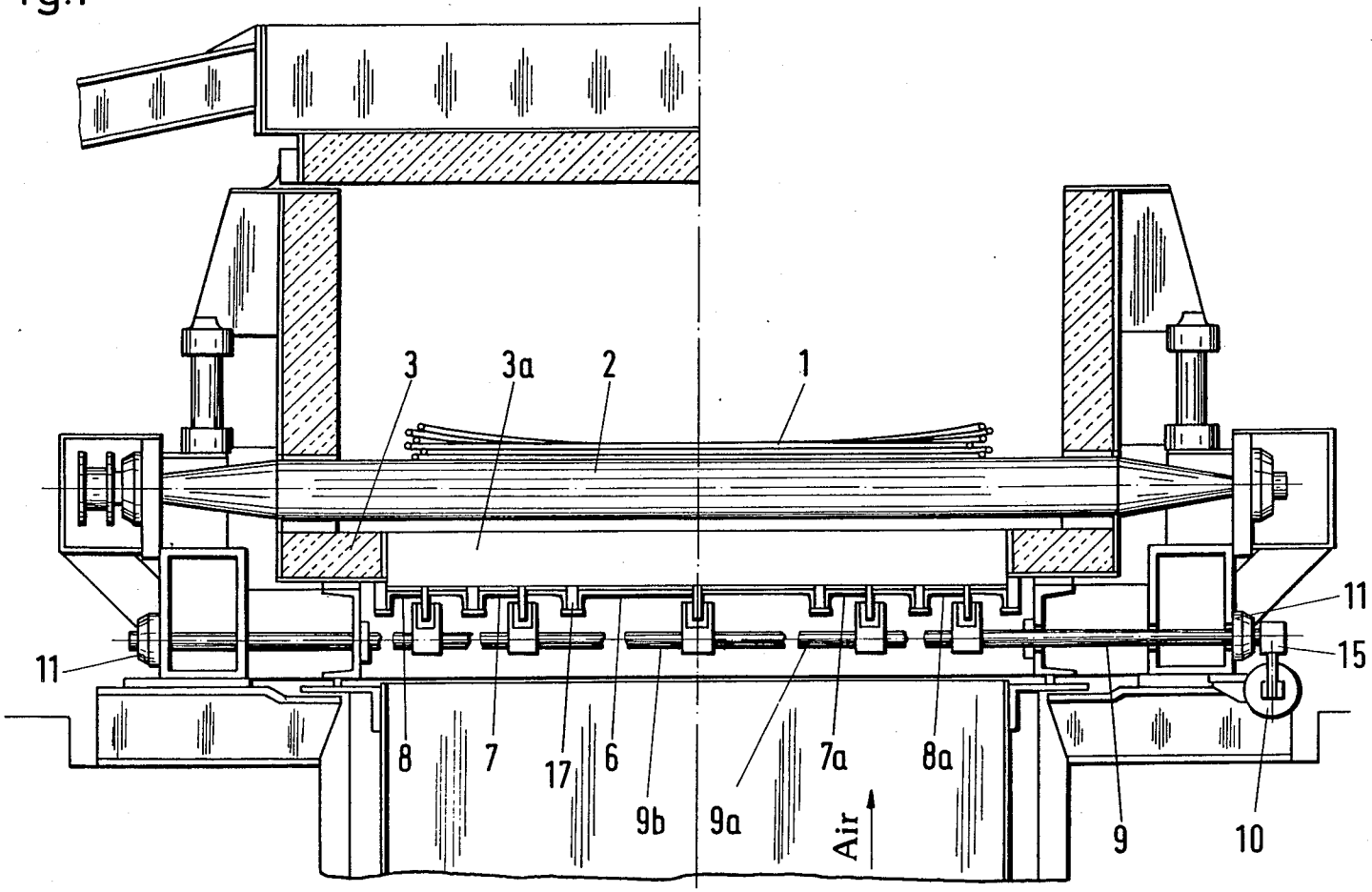
FIG. 1 is a cross section through a cooling device according to the invention in the vicinity of a transverse slot.
Figure 2:
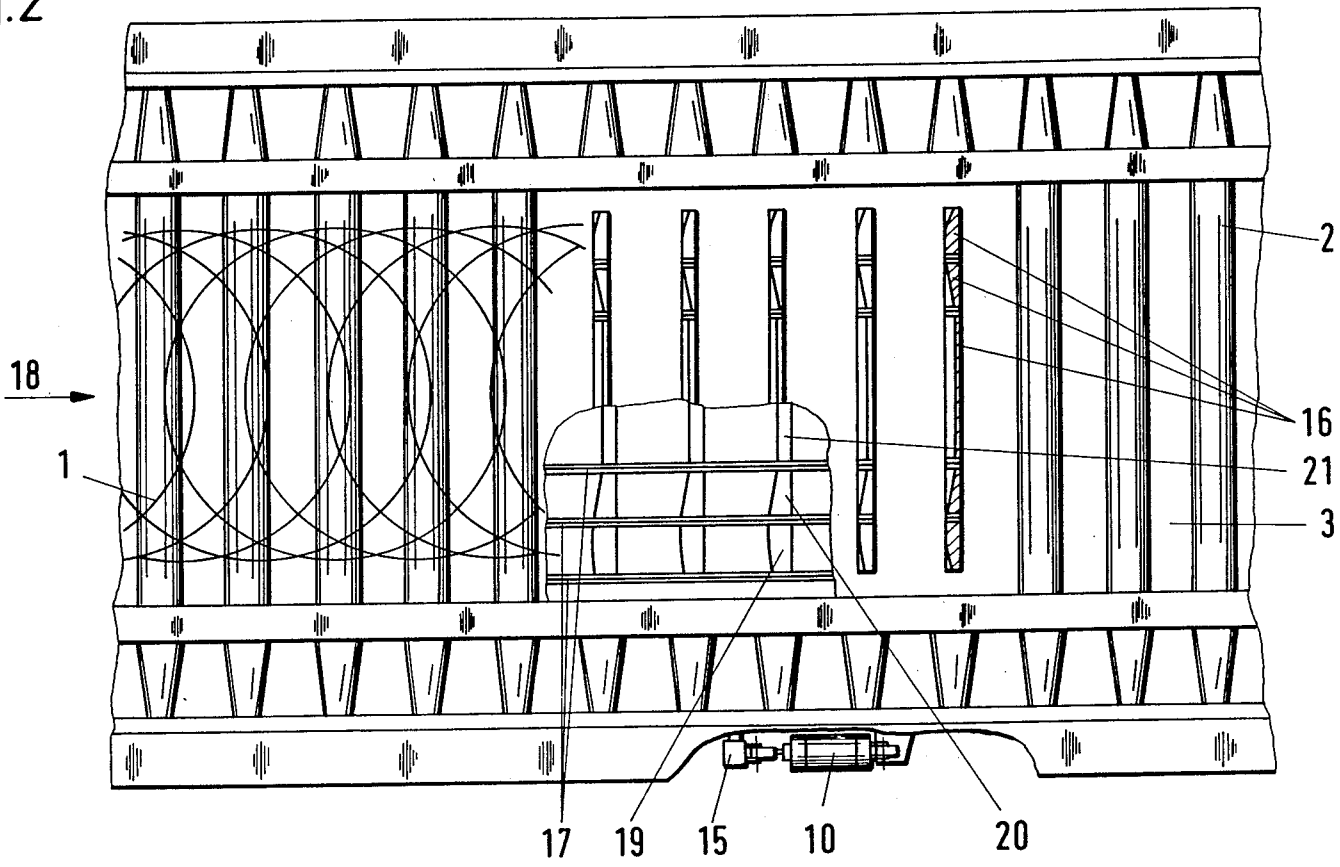
FIG. 2 is an overhead view of the cooling device according to the invention.
Figure 3:
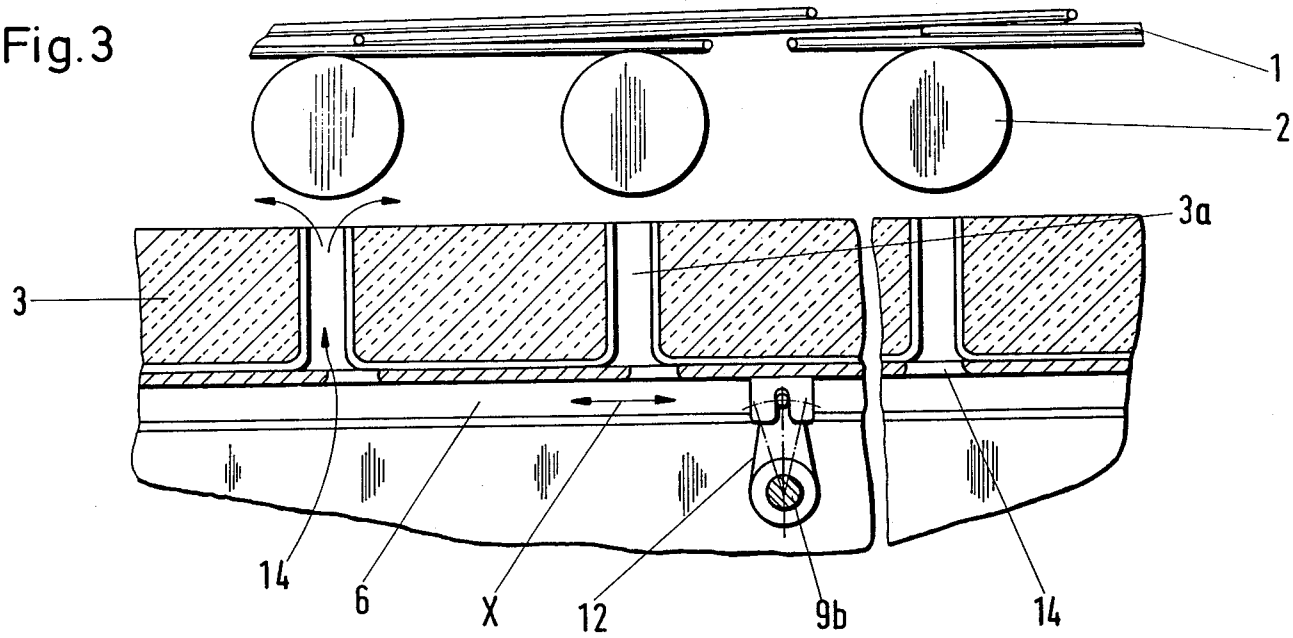
FIG. 3 is a cross section through the transport rollers and the transverse slots.
Figure 4:
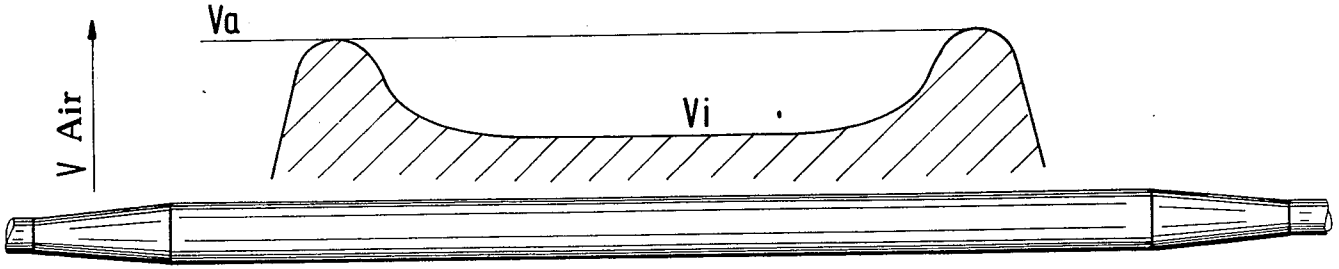
FIG. 4 is a diagram indicating the speed of the cooling air over the width of the conveyor.

As shown in FIGS. 1 and 2, the spread out wire turns 1 are conveyed by chain-driven transport rollers 2 to a coiling station (not shown). To achieve the metallurgical characteristics mentioned above, the wire turns must be cooled as uniformly as possible. As can be seen in FIG. 2, portions of the wire turns 1, close to the ends of the rollers 2, are more closely disposed to one another, whereby these portions would cool more slowly than other parts of the turns and thereby deleteriously affect the characteristics of the relevant wire. In order to cool these outer disposed portions of the wire 1, additional air is provided to cool them at substantially the same rate as the remaining portions of the wire 1. Since the cooling rate is largely a function of the velocity of the cooling air, the air velocity as shown in FIG. 4 must be adjustable between Vi and Va as a function of the accumulation of the material and the cross section of wire. It must also be possible to lower this curve for lower cooling rates. In the vicinity of each transport roller 2, there is, in the tuyere bottom, a transverse slot 3*a* running transverse to the conveyor. Below the tuyere bottom 3, next to one another there are five slotted plates 6, 7, 7*a*, 8 and 8*a*, which can be moved in the longitudinal direction. The slotted plates slide in guides 17. The slotted plates are moved independently of one another by their own adjustment devices 10, or manually by means of lever 15 of the shafts 9, 9*a* and 9*b* mounted in the roller bearings 11 and the corresponding crank 12. Cranks are connected to the shafts, which cranks engage with the plates, with the slots therein allowing air to flow through openings 14 through the slots 3*a*.

In one embodiment, each individual plate may be moved independently by its own adjusting device with its own attached paraphernalia or alternatively in groups with other of the plates.

The slotted plates, seen in cross section, have sides bent in the shape of a U, and there are slots 19, 20 and 21 in the upper side of the slotted plates, as shown in FIG. 2 in the diagram of the tuyere bottom. The distances between the slots 21, 20 and 19 on each slotted plate are equal to the distances between the transverse slots 3*a*. In other words, the slots 19, 20 and 21 can be made to coincide with the transverse slots 3*a*. Since the opening cross sections of the slots 19, 20 and 21 are at least as large as the opening cross sections of the slots 3*a*, when the slot and the transverse slot coincide, the maximum amount of cooling air can be transported through the transverse slots. By moving all or some of the slotted plates 6, 7, 7*a*, 8 and 8*a*, the transverse slots 3*a* can be opened and closed to be more or less closed, as shown in the upper half of FIG. 2 and indicated by the number 16.

The slotted plates 7, 7*a* and 8, 8*a* accordingly have a diagonal configuration in this area where material accumulations are to be expected, that is, where the overlapping of the wire turns has given relationship, and as a result of the diagonal control edges, a controlled reduction of the nozzle inputs can be achieved. This reduction of the nozzle inputs causes a change in the velocity of the air at the nozzle output, in approximately the ratio of the slot width to the nozzle width according to the flow continuity relationship of fluid and the equation therefor.

In summing up, the invention relates to a cooling device for cooling turns which, when overlapping one another, are spread out on a horizontal conveyor and which are cooled by air which can be supplied by transverse slots positioned below the rollers 2 of the conveyor. The intensity, that is, speed, volume and direction of the cooling air can be modified over the width of the coil of wire turns 1, which turns 1 are spread out along the top of the horizontal conveyor. The horizontal conveyor's transverse slots 3*a*, which preferably extend from one side of the conveyor to the other, have adjusting apparatus to change the flow of air through the slots 3*a* to vary this flow at different positions along the length of the slots 3*a* which are positioned across the width of the horizontal conveyor. In one embodiment of the invention, these transverse slots are at least, at some portions thereof, partly obstructed or covered by the action of the movable shutters 6, 7, 8, 7*a* and 8*a* which are movable along the length of the horizontal conveyor, that is, they are movable along the direction of movement, back and forth, along the horizontal conveyor. Further, the edges of the shutters 6, 7, 7*a* and 8*a* control the flow of air through the transverse slots 3*a*. These edges of the shutters 6, 7, 8, 7*a* and 8*a* which control the flow of air run preferably at an angle to the direction of movement of the shutters. As the shutters 6, 7, 8, 7*a* and 8*a* preferably run at right angles to the length of the transverse slots, that is, the edges of the shutters are at an angle to the edges of the transverse slots, these control edges also make an angle to the edges of the transverse slots.

Across the length of the transverse slots, which have their length disposed from one side of the conveyor to the other, there are preferably disposed several shutters, one next to the other, across the horizontal conveyor.

As indicated above, the shutters 6, 7, 8, 7*a* and 8*a* may be moved individually to vary the flow of air at a particular point or region where the coils of wire are especially closely packed together, or the shutters 6, 7, 8, 7*a* and 8*a* may move in groups, preferably of two, to vary the profile of the flow of air over a number of the shutters 6, 7, 8, 7*a* and 8*a*. The shutters comprise a plurality of slotted plates such as 6, 7, 8, 7*a* and 8*a* which cover, at least partially, the slots in the upper portion of the conveyor under the chain-driven transport rollers 2. As indicated previously, the several transverse slots may have nozzle configurations formed by the U-shaped elements 3*b*. The orifices 14 in the slotted plates 6, 7, 8, 7*a* and 8*a* are preferably separated from one another the same distance as the spacing between the transverse slots 3*a*. Further, the cross section openings 14 in the slotted plates 6, 7, 8, 7*a* and 8*a* preferably are openings which are at least equal to the cross section are to that of their corresponding transverse slots 3*a*.

In one preferred embodiment of the present invention, over the width of the horizontal conveyor 2, there are five slotted plates 6, 7, 7*a*, 8 and 8*a* disposed along the length of the transverse slots 3*a*. The outer two of these slotted plates 8 and 8*a*, and the slotted plates immediately adjacent thereto, are preferably independently movable in pairs. This movement of the slotted plates 7, 7*a*, 8 and 8*a*, as indicated above, is in the direction of movement of the wire turns, that is, along the length of the conveyor 2. To provide greater adjustment at the outer portions of the width of the conveyor 2, the surfaces of the shutters 6, 7, 8, 7*a* and 8*a* are preferably diagonally disposed to the direction of movement of the shutters 6, 7, 8, 7*a* and 8*a* themselves to provide precise adjustment of air flow. By this mechanism, a greater amount of air can be applied to the outer portions of the coils, which are more closely packed, one to the other, at the outer extremities of the preferably collapsed helix of the turns, thereby providing greater cooling at these portions along the outer extremities of the collection of turns of wire, than to the inner portions where the portions of the wire turns are further apart.

The invention as described hereinabove in the context of a preferred embodiment is not to be taken as limited to all of the provided details thereof, since modifications and variations thereof may be made without departing from the spirit and scope of the invention.

What is claimed is:

1. A cooling apparatus for cooling a plurality of turns of wire, said apparatus comprising:

means for receiving the turns of wire, said receiving means comprising a horizontal conveyor;

said horizontal conveyor having an upper portion for receiving the turns of wire and a width dimension;

means for directing air towards said horizontal conveyor and for directing air towards the turns of wire when disposed on said horizontal conveyor;

said means for directing air being disposed below said upper portion of said horizontal conveyor and for directing air substantially upwardly towards said upper portion which is for receiving the turns of wire;

means for supplying air to said air directing means for cooling turns of wire disposed on said upper portion;

said air supplying means comprising a plurality of transversely disposed slots;

said slots having a length dimension and a width dimension, said length dimension being disposed across the width of said conveyor;

said air supplying means having means for directing said cooling air through said slots;

said slots having adjustment means for varying a flow of cooled air through at least a portion of said slots; and said adjustment means comprising a plurality of at least partially movable shutters for varying the openings of the transverse slots and thus, for varying flow characteristics of air flowing through at least a portion of said slots for providing greater air flow intensity over portions of the plurality of wire turns having greater proximity to one another than portions of the wire turns having less proximity to one another.

2. The cooling apparatus for cooling a plurality of turns of wire according to claim 1, wherein at least some of the shutters have control edges;

said shutters being disposed with respect to their corresponding slots to run in a direction of movement which is transverse to the length dimension of their corresponding slots;

at least a portion of the control edges of said shutters being disposed angularly substantially nonorthogonally to said direction of movement of said shutters.

3. The cooling apparatus for cooling a plurality of turns of wire according to claim 1, wherein at least some of the shutters have control edges;

said shutters being disposed with respect to their corresponding slots to run in a direction of movement which is transverse to the length dimension of their corresponding slots;

said slots having edges disposed in said length dimension;

at least a portion of the control edges of said shutters being disposed diagonally to said edges of said slots.

4. The cooling apparatus for cooling a plurality of turns of wire according to claim 1, wherein a plurality of shutters are disposed along the length of said transverse slots, said shutters being disposed substantially next to one another and being movable in a direction along the horizontal conveyor.

5. The cooling apparatus for cooling a plurality of turns of wire according to claim 1, wherein said shutters are disposed one adjacent the other along the length dimension of said transverse slots for moving substantially orthogonally to the length dimensions of said slots.

6. The cooling apparatus for cooling a plurality of turns of wire according to claim 5, wherein said shutters are individually movable.

7. The cooling apparatus for cooling a plurality of turns of wire according to claim 5, wherein said shutters are movable in groups.

8. The cooling apparatus for cooling a plurality of turns of wire according to claim 1, wherein said shutters comprise elongated plates having orifices;

said plates being disposed for covering and uncovering simultaneously a plurality of said slots.

9. The cooling apparatus for cooling a plurality of turns of wire according to claim 7, wherein said shutters comprise elongated plates having orifices;

said plates being disposed for covering and uncovering simultaneously a plurality of said slots.

10. The cooling apparatus for cooling a plurality of turns of wire according to claim 8, wherein said slots are disposed a given distance, one from the other, along the direction of movement of said conveyor;

said orifices in said plates are disposed, one from the other, on said plates at a distance substantially equivalent to said given distance between said slots.

11. The cooling apparatus for cooling a plurality of turns of wire according to claim 10, wherein said plates have solid portions adjacent said orifices, and said slots have cross sectional areas for being obstructed by at least one of said plates, said solid portions of said plates having an area for obstructing said slots being at least as great as the slot cross sectional area of the portion of said slots to be obstructed by said plates.

12. The cooling apparatus for cooling a plurality of turns of wire according to claim 5, wherein said plates comprise five plates, two of which five plates are outer plates and another two of said five plates being plates adjacent said outer plates and disposed inwardly therefrom, and further, an inner plate disposed between the four other plates.

13. The cooling apparatus for cooling a plurality of turns of wire according to claim 12, including means for moving said two outer plates simultaneously with one another.

14. The cooling apparatus for cooling a plurality of turns of wire according to claim 13, including means for moving said two adjacent plates simultaneously with one another.

15. The cooling apparatus for cooling a plurality of turns of wire according to claim 12, wherein the transverse slots have edges, the orifices in the four outer plates have edges which run diagonal to the edges of the transverse slots; and means for selectively and positionally adjusting the plates relative to the amount of wire material to be disposed immediately above the plates on said conveyor.

* * * * *